US005678660A

United States Patent [19]

Karner et al.

[11] Patent Number: 5,678,660

[45] Date of Patent: Oct. 21, 1997

[54] OVERHEAD SUPPORTING BEAM FOR AN ELEVATOR DOOR AND A DOOR MECHANISM ARRANGEMENT

[75] Inventors: Gerhard Karner, Scheibbs; Franz Mittermayer, Loich; Franz Josef Karner, St. Anton, all of Austria

[73] Assignee: Kone Oy, Helsinki, Finland

[21] Appl. No.: 550,651

[22] Filed: Oct. 31, 1995

[30] Foreign Application Priority Data

Oct. 31, 1994 [FI] Finland ..... 945129

[51] Int. Cl.[6] ..... B66B 13/06

[52] U.S. Cl. ..... 187/333; 187/334

[58] Field of Search ..... 187/333, 334, 187/325, 313; 49/120, 116

[56] References Cited

U.S. PATENT DOCUMENTS

| | | | |
|---|---|---|---|
| 3,315,767 | 4/1967 | Walter | 187/57 |
| 3,426,480 | 2/1969 | Dzamba | 187/334 |
| 4,177,881 | 12/1979 | Kappenhagen | 187/334 |

FOREIGN PATENT DOCUMENTS

| | | | |
|---|---|---|---|
| 643134 | 6/1992 | Canada | 187/334 |
| 0242545 | 10/1987 | European Pat. Off. . | |
| 0458658 | 11/1991 | European Pat. Off. . | |

*Primary Examiner*—Kenneth Noland

*Attorney, Agent, or Firm*—Birch, Stewart, Kolasch & Birch, LLP

[57] ABSTRACT

In the overhead supporting beam of an elevator door, the roller races (4,5) for the rollers of the door panels are formed from one piece with the overhead supporting beam (1). The door operating mechanism (11) with the door operating motor (15) is fitted to form a single unit with the overhead supporting beam (1) of the door.

29 Claims, 4 Drawing Sheets

OVERHEAD SUPPORTING BEAM FOR AN ELEVATOR DOOR AND A DOOR MECHANISM ARRANGEMENT

FIELD OF THE INVENTION

The present invention relates to an overhead supporting beam for an elevator door and to a door mechanism arrangement for an elevator door.

DESCRIPTION OF THE BACKGROUND ART

In automatic sliding door solutions, one problem has been the thickness of the implementation. This has become manifest especially in moderization projects where old turn doors or lattice gates have been replaced with automatic doors. Conventionally, the door panels of sliding elevator doors are suspended with rollers on a roller race above the door. An example of this type of suspension can be found in EP patent specification 0 242 545 B1. The roller races are attached by means of bushes to the overhead beam. The roller races are placed one above the other in a vertical plane at a relatively large distance from each other. The solution presented in patent specification EP 0 242 545 B1 achieves a relatively thin door suspension system, and this makes it well suited for use e.g. in elevator modernization projects in which many other overhead beam systems of a larger thickness are not applicable. However, it is fairly expensive to manufacture because it comprises numerous components, and these have to be installed to produce a functional assembly. Its high price makes it inapplicable in many new elevator installations despite the fact that efficient and economic use of building space is also one of the objectives in the design of new elevators. In general, the problem is not only the number of components but also the large number of different components.

SUMMARY OF THE INVENTION

To satisfy the needs referred to above and to solve the problems mentioned, an overhead supporting beam for an elevator door and a door mechanism arrangement of a new type are presented as an invention. The overhead supporting beam of the invention is characterized by an overhead supporting beam for an elevator door having at least one panel, said beam comprising roller races for rollers of the at least one panel of the elevator door, the roller races and overhead supporting beam being formed from one piece, the one piece beam having a portion with generally a C-shape, the roller faces being on the C-shaped portion of the beam. The door mechanism arrangement of the invention is characterized by a door operating mechanism with a door operating motor, an overhead supporting beam for the door, the overhead supporting beam being a one piece beam with roller races and the overhead beam and door operating mechanism forming a single unit, the door operating mechanism being mounted directly on the one piece supporting beam.

The advantages achievable by the invention include the following:

The same overhead supporting beam is applicable for both landing and car doors, thus reducing the number of different components in the elevator.

The same overhead supporting beam can be used with doors of widely differing types, such as e.g. side-opening 1-panel doors and center-opening 2-panel doors and in telescoping doors such as e.g. side-opening 2-panel and center-opening 4-panel doors.

The roller races for the door supporting rollers are integrated with the overhead supporting beam and both sides of the beam are provided with a guide surface for both the supporting roller that carries the weight of the door and for a counter roller. The beam profile is easy to manufacture e.g. by bending from a steel plate or by extruding through a die e.g. from aluminium or other suitable material.

The door mechanism arrangement of the invention is integrated with the overhead supporting beam of the door, which makes installation simpler.

The door mechanism arrangement integrated with the overhead supporting beam as provided by the invention is applicable for use in modernization projects, in which the space between the car and the shaft wall is often too narrow for conventional solutions. The solution of the invention is not very high, either, so placing it in the vertical direction is not difficult. In new elevator installations, the door mechanism arrangement allows a saving in the space required by an automatic door in the cross-section of the elevator shaft.

The overhead supporting beam can be easily fixed to car or landing structures by the flat surfaces in the upper part of the beam.

The invention allows very thin door mechanism/overhead supporting beam systems to be achieved for both the car door and the landing door. In the case of a one-panel door, the space required may be 45 mm or less as measured from the sill line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of a few application examples by referring to the attached drawings which are given by way of illustration only, and thus are not limitative of the present invention, and in which.

DETAILED DESCRIPTION OF THE PREFERRED EMBODIMENTS

Figure 1:
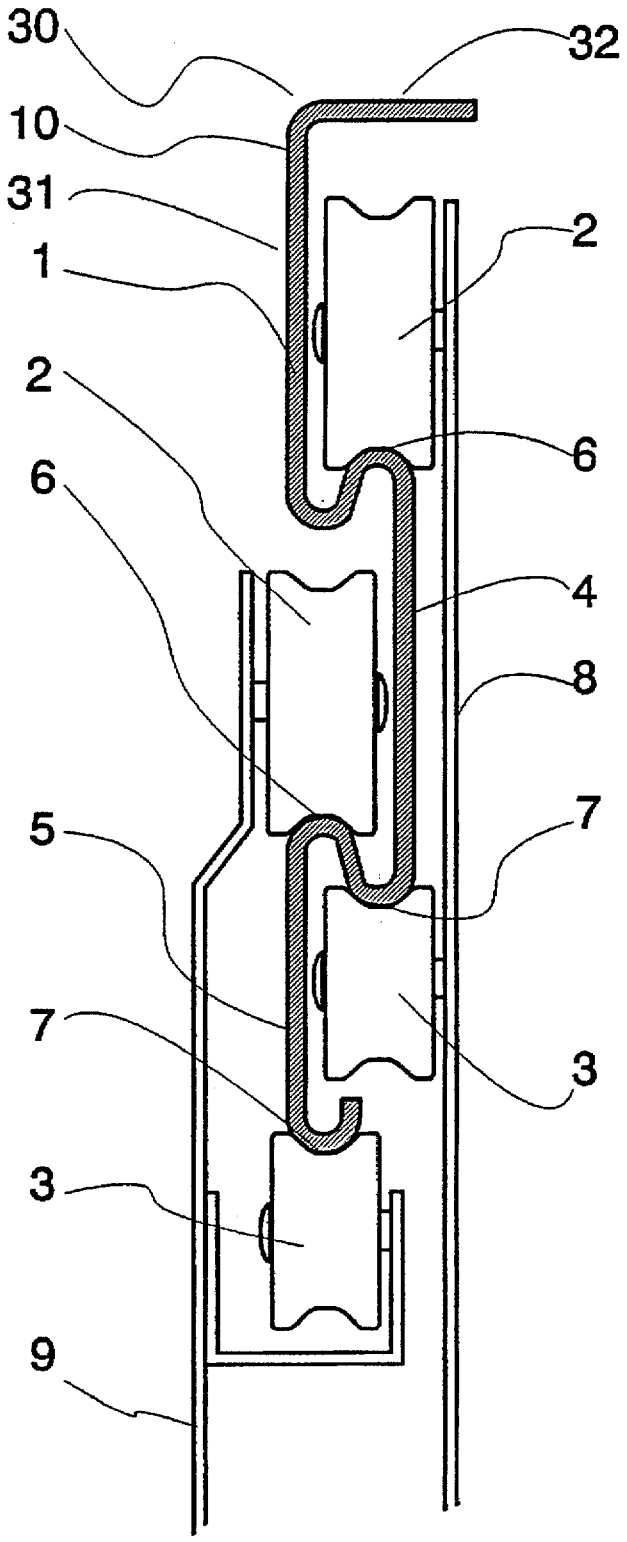
FIG. 1 presents an overhead door supporting beam as provided by the invention.

FIG. 1 presents an overhead supporting beam 1 as provided by the invention. The figure shows the cross-sectional form of the overhead supporting beam and the placement of the panel supporting rollers 2 and their counter rollers 3 relative to the supporting beam 1. Formed in the supporting beam are roller races 4,5 for the rollers 2,3. The roller races have an upward stop face 6 for the supporting rollers 2 and a downward stop face 7 for the counter rollers 3. The rollers 2,3 are rotatably mounted on supporting plates 8,9 supporting the door panels. The upper roller race 4 is primarily intended for the suspension of the door panels of a side-opening 1-panel door or a center-opening 2-panel door and in a telescoping door for the suspension of the fast door panels of a side-opening 2-panel door or a center-opening 4-panel door. The upper roller race 4 is primarily intended for the suspension of fast door panels. The lower roller race 5 is primarily intended for the suspension of the slow door panels of a side-opening 2-panel door or a center-opening 4-panel door. A preferable form of the overhead supporting beam 1 is as follows. The roller races 4,5 are shaped in the form of a flat-backed letter C, with their open sides facing towards opposite sides of the overhead supporting beam 1. The upper C-shape 4 starts directly from the upper cleat of the lower C-shape 5. The stop faces 6,7 on the roller races 4,5 consist of the curved upper and lower surfaces of the C-shapes. Starting from the upper cleat of the upper C-shape, the overhead supporting beam 1 is so bent that it again continues upwards. The upper part 10 of the overhead supporting beam 1 can be provided with one or more elbows to stiffen the beam structure and/or to produce a box-like shape. The overhead supporting beam is fixed to the elevator car or to the landing structures by the flat surfaces 31 and/or 32 or by means of separate fixtures. The supporting and counter rollers 2,3 are provided with a groove in their outer edge, designed to fit the curved stop faces 6,7 of the roller races. The counter rollers 3 need not necessarily be provided with grooves.

Figure 3:
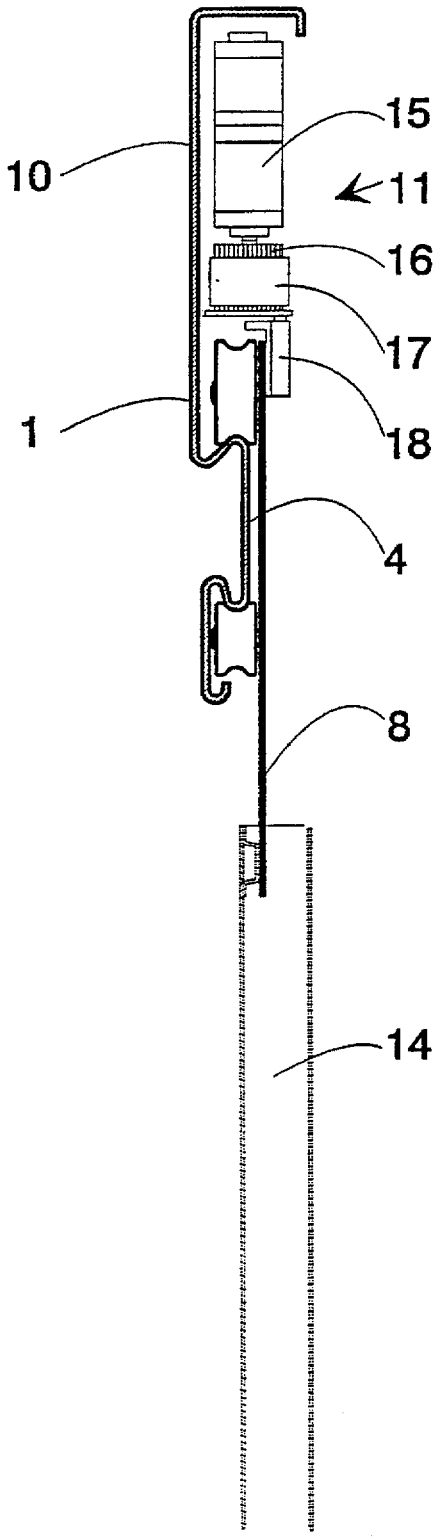
FIG. 3 illustrates the invention as applied to a 2-panel center-opening door of an elevator car.
Figure 2:
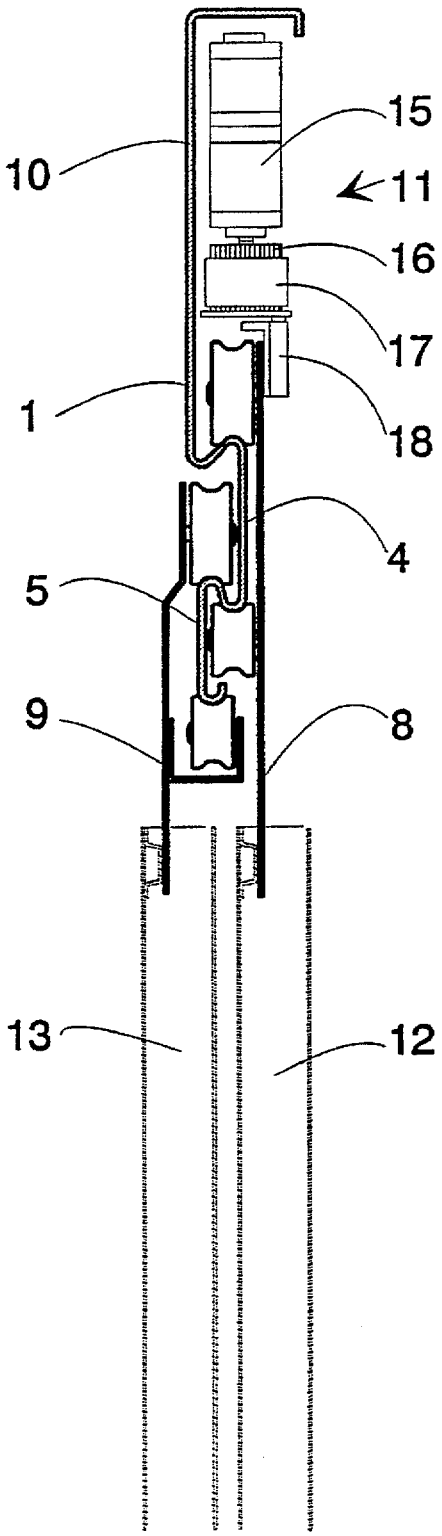
FIG. 2 illustrates the invention as applied to a telescoping door of an elevator car

FIG. 2 shows an overhead supporting beam 1 for a telescoping door of an elevator car and FIG. 3 for a center-opening 2-panel door, together with an operating mechanism 11, seen from the lengthwise direction of the overhead supporting beam. The operating mechanism 11 is mounted inside the overhead supporting beam 1, at least the essential parts of the mechanism 11 being placed within the height and thickness dimensions of the beam 1. The electronic apparatus 21 used to control the door movements can also be placed in the overhead supporting beam 1. In a telescoping door, the door panels 12 and 13 are attached to panel supporting plates 8 and 9. In the door in FIG. 3, door panel 14 is attached to supporting plate 8. Of the operating mechanism, FIG. 2 and 3 show the drive motor 15, which rotates a wheel 16 driving a belt 17. The belt 17 is preferably a cogged belt and the wheel 16 a cogged wheel. Instead of belt drive, it is possible to use chain or cable drive or the like. The supporting plate 8 is connected to the belt 17 by means of an arm 18.

Figure 4:
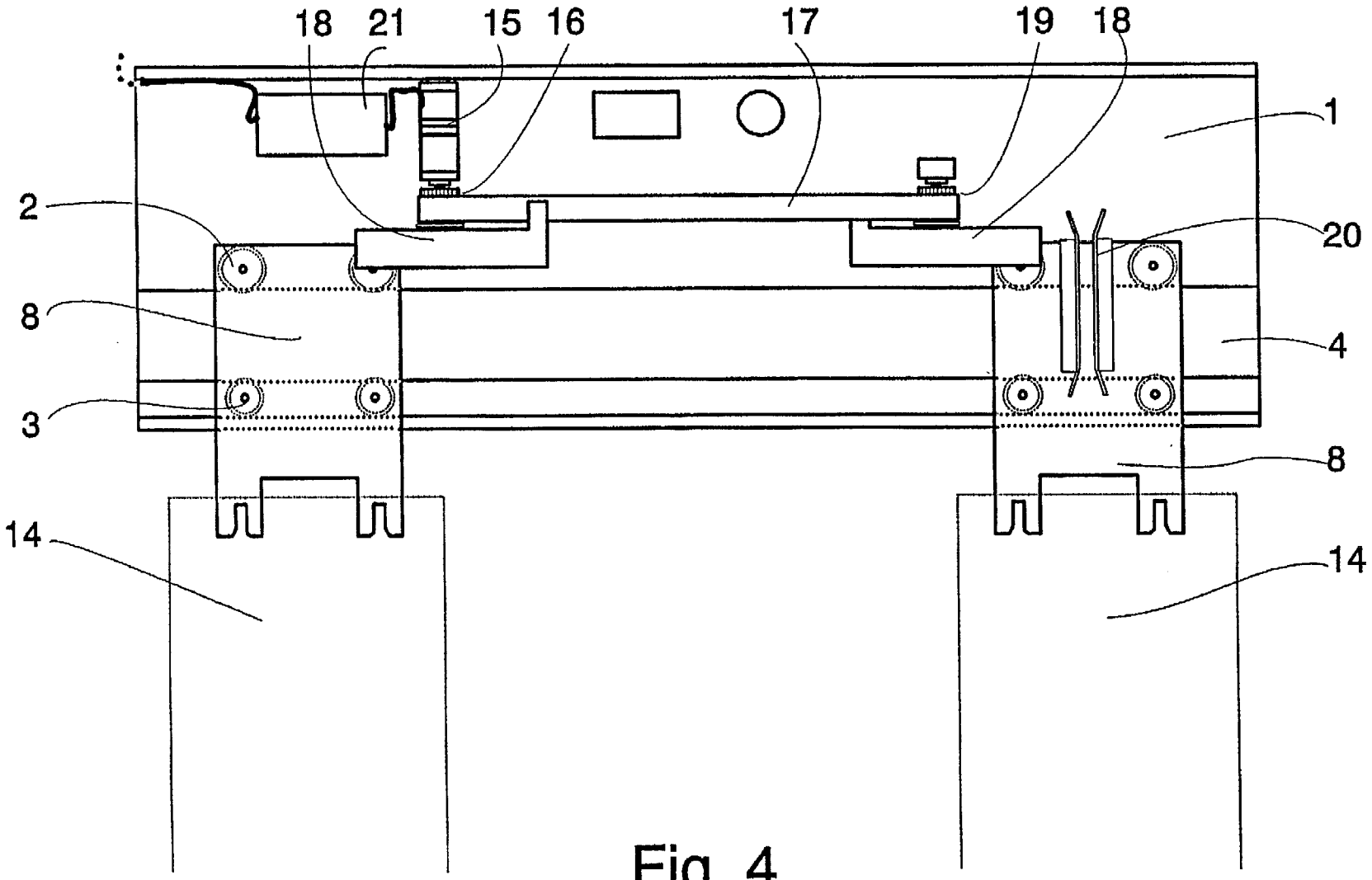
FIG. 4 presents the application of FIG. 3 as seen from another direction.

FIG. 4 presents the door of FIG. 3 as seen from the side of the roller race 4. The door panels 14 are suspended on supporting plates 8. The door operating motor 15 rotates the wheel 16 driving the belt 17. The belt 17 is passed around the wheel 16 rotated by the operating motor and another wheel 19 rotating freely. The door is of the center-opening type and the supporting plates 8 are connected to the belt 17 by means of arms 18 in such a way that one of the arms 18 is attached to a belt portion moving in one direction and the other arm is attached to the belt portion moving in the opposite direction. At least one of the supporting plates 8 is provided with a door coupler 20. The door coupler 20 transmits the motion of the car door to the landing door, whose door supporting plate is provided with a door coupling counter piece. In FIG. 2, 3 and 4, the motor 15 selected is such that the axis of rotation of the wheel 16 is upright and the belt 17 lies as it were in an edgewise position. Within the inventive idea, the motor could just as well be of a type which is provided with an output that rotates the belt driving wheels in a vertical plane.

Figure 5:
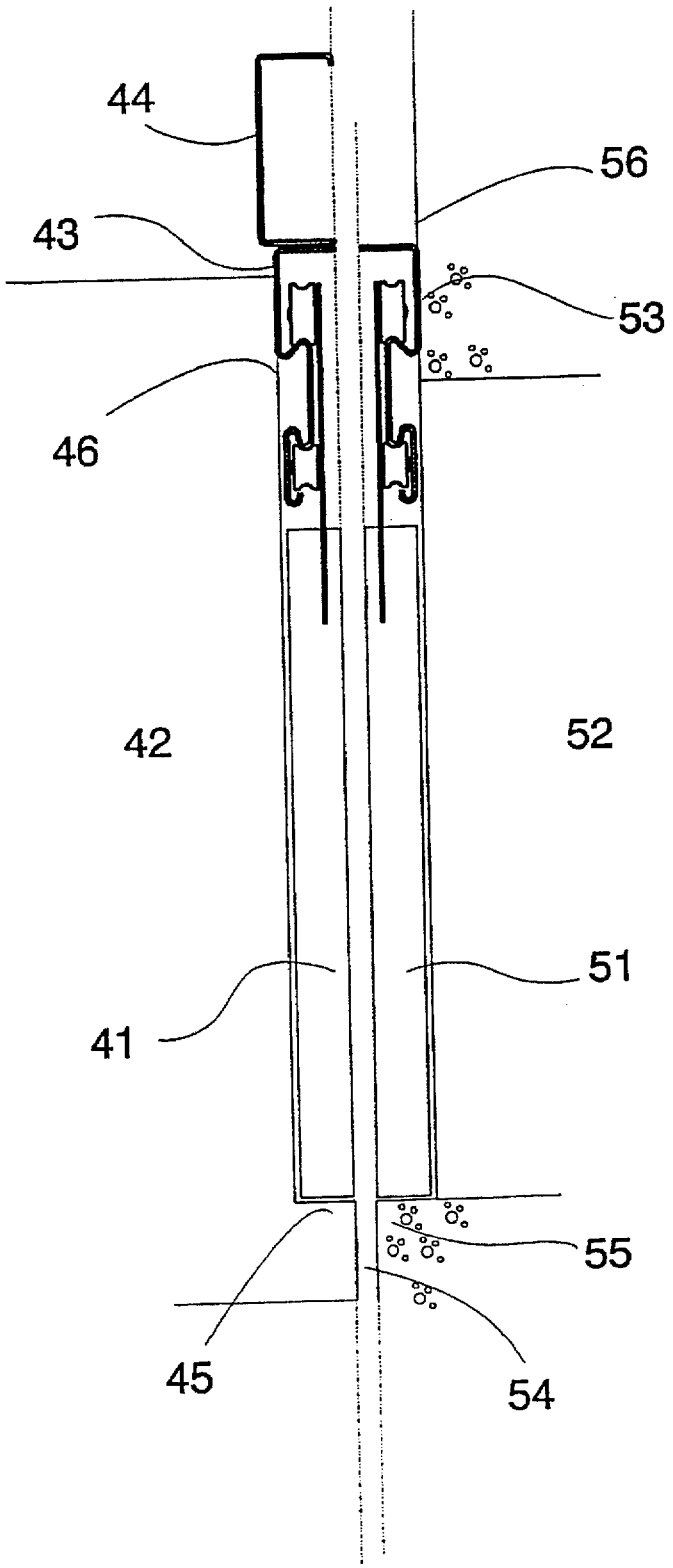
FIG. 5 presents car and landing doors with overhead supporting beams as provided by the invention.

In FIG. 5, the car door 41 is suspended on an overhead supporting beam 43 with a roller race, the beam being mounted on the head of the elevator car 42. The supporting beam 43 has an upper part 44 with space e.g. for the door operating mechanism. The upper part 44 may be a box structure attached to the supporting beam 43 or it may be a part formed from the same piece of plate with the supporting beam. The landing door 51 is suspended on a supporting beam 53 mounted on the landing 52. Between the landing sill 55 and the car sill 45 is a sill clearance 54. In horizontal lay-out, the landing door 51 with its supporting equipment is on the landing side of the sill clearance and the car door 41 with its supporting equipment is on the car side of the sill clearance. The supporting beams 43 and 53 do not require substantially more space between the sill clearance 54 and the car head surface 46 or between the sill clearance 54 and the shaft wall 56 than the doors 41,42 do. In practice, this means that a one-panel door with its overhead supporting beam will need clearly less space between the sill clearance and the shaft wall or between the sill clearance and the car structure than at present (typically about 75 mm). In a preferable solution according to the invention, a one-panel door with its overhead supporting beam only requires a space about 45 mm in thickness or even less if the thickness of the door panel is reduced from the conventional value of about 35 mm and the clearance between the door panel and the other door panel or between the door panel and the car structure or shaft wall is about 10 mm. The thickness of the space required by a two-panel telescoping door is preferably at most 90 mm, and if the beam thickness is at most 45 mm, it can be used as such for the suspension of a telescoping door as well as a one-panel door without a need to make the gap between the car or shaft wall and the sill clearance larger than the thickness required by the door.

It is obvious to a person skilled in the art that the embodiments of the invention are not restricted to the examples described above, but that they may instead be varied in the scope of the following claims.

We claim:

1. An overhead supporting beam for an elevator door having at least one panel, said beam comprising roller races for rollers of the at least one panel of the elevator door, the roller races and overhead supporting beam being formed from one piece, the one piece beam having a portion with generally a C-shape, the roller races being on the C-shaped portion of the beam.

2. The overhead supporting beam according to claim 1, wherein the roller races have upper and lower stop faces for the rollers.

3. The overhead supporting beam according to claim 2, wherein the upper and lower stop faces have a curved shape conforming to a shape of the rollers.

4. The overhead supporting beam according to claim 2, wherein at least two upper stop faces are provided.

5. The overhead supporting beam according to claim 1, wherein at least two roller races are provided in the one piece beam, each roller race having an upper stop face and a lower stop face for the rollers.

6. The overhead supporting beam according to claim 1, wherein the overhead supporting beam with the roller races is formed from a bent metal plate.

7. The overhead supporting beam according to claim 1, wherein the overhead supporting beam with the roller races is formed by extruding and is a profiled beam.

8. The overhead supporting beam according to claim 7, wherein the overhead supporting beam with the roller races is a profiled aluminum beam.

9. The overhead supporting beam according to claim 7, wherein the overhead supporting beam has a thickness not exceeding a total thickness of the door panel plus a clearance from the door panel to another door panel, to an elevator car or to a shaft wall.

10. The overhead supporting beam according to claim 9, wherein the beam thickness is about 40 to 50 mm or less.

11. The overhead supporting beam according to claim 1, wherein each of the roller races are in a C-shaped portion of the beam with each C-shaped portion having a flat-backed C-shape, each C-shaped portion having an open side and the open sides of adjacent C-shaped portions facing towards opposite sides of the support beam.

12. The overhead supporting beam according to claim 11, wherein each of the C-shaped portions have an upper cleat, an upper C-shaped portion starting from an upper cleat of the lower C-shaped portion and extending to the upper cleat of the upper C-shaped portion whereat the one piece supporting beam continues further upwards.

13. The overhead supporting beam according to claim 12, wherein each of the C-shaped portions have upper and lower surfaces forming upper and lower stop faces, respectively, for the rollers.

14. The overhead supporting beam according to claim 11, wherein each of the C-shaped portions have upper and lower surfaces forming upper and lower stop faces, respectively, for the rollers.

15. The overhead supporting beam according to claim 1, wherein the supporting beam has at least one elbow in an upper part thereof for at least one of reinforcing the beam and providing a box form.

16. The overhead supporting beam according to claim 1, wherein an upper portion of the overhead supporting beam is connected directly to at least one of an elevator car and landing structures.

17. A door mechanism arrangement for an elevator with a door, comprising a door operating mechanism with a door operating motor, an overhead supporting beam for the door, the overhead supporting beam being a one piece beam with roller races and the overhead beam and door operating mechanism forming a single unit, the door operating mechanism being mounted directly on the one piece supporting beam.

18. The door mechanism arrangement according to claim 17, wherein the operating mechanism is placed in the overhead supporting beam within thickness and height dimensions of the overhead supporting beam.

19. The door mechanism arrangement according to claim 17, wherein the overhead supporting beam has an upper part with a box structure, the box structure being part of the one piece supporting beam and defining a space for the door operating mechanism.

20. The door mechanism arrangement according to claim 17, wherein the operating mechanism is located over the overhead supporting beam.

21. The door mechanism arrangement according to claim 17, wherein the overhead supporting beam has a portion with generally a C-shape, the roller races being on the C-shaped portion of the beam.

22. The door mechanism arrangement according to claim 17, wherein at least two roller races each having an upper stop face are provided on the one piece supporting beam, the roller races being for rollers of the elevator door.

23. The door mechanism according to claim 17, wherein an upper portion of the overhead supporting beam is connected directly to at least one of an elevator car and landing structures.

24. An overhead supporting beam for an elevator door having at least one panel, said beam comprising roller races for rollers of the at least one panel of the elevator door, the roller races and overhead supporting beam being formed from one piece, the one piece beam having an elbow extending over the races, a generally vertical plane intersecting the races also intersects the elbow of the beam.

25. The overhead supporting beam according to claim 24, wherein at least two roller races are provided in the one piece beam, each roller race having an upper stop face and a lower stop face for the rollers.

26. The overhead supporting beam according to claim 24, wherein the overhead supporting beam has a thickness not exceeding a total thickness of the door panel plus a clearance from the door panel to another door panel, to an elevator car or to a shaft wall.

27. The overhead supporting beam according to claim 24, wherein each of the roller races are in a C-shaped portion of the beam with each C-shaped portion having a flat-backed C-shape, each C-shaped portion having an open side and the open sides of adjacent C-shaped portions facing towards opposite sides of the support beam.

28. The overhead supporting beam according to claim 24, wherein the elbow is in an upper part of the supporting beam for providing a box form for housing a door operating mechanism with a door operating motor.

29. The overhead supporting beam according to claim 24, wherein an upper portion of the overhead supporting beam is connected directly to at least one of an elevator car and landing structures.

* * * * *